US009227409B2

(12) United States Patent
Takano et al.

(10) Patent No.: US 9,227,409 B2
(45) Date of Patent: Jan. 5, 2016

(54) WASTE INK ABSORBER, WASTE INK TANK, LIQUID DROPLET EJECTING DEVICE

(71) Applicant: SEIKO EPSON CORPORATION, Tokyo (JP)

(72) Inventors: Hidehiro Takano, Nagano (JP); Shunichi Seki, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/107,022

(22) Filed: Dec. 16, 2013

(65) Prior Publication Data

US 2014/0184691 A1 Jul. 3, 2014

(30) Foreign Application Priority Data

Dec. 27, 2012 (JP) ..... 2012-284513

(51) Int. Cl.
*B41J 2/165* (2006.01)
*B41J 2/17* (2006.01)

(52) U.S. Cl.
CPC ..... *B41J 2/16523* (2013.01); *B41J 2/16508* (2013.01); *B41J 2/1721* (2013.01)

(58) Field of Classification Search
USPC ..... 347/31, 36
See application file for complete search history.

(56) References Cited

U.S. PATENT DOCUMENTS

| | | | | |
|---|---|---|---|---|
| 2005/0151808 | A1* | 7/2005 | Andersen et al. | 347/86 |
| 2006/0017770 | A1* | 1/2006 | Harada et al. | 347/36 |
| 2009/0219339 | A1* | 9/2009 | Harada | 347/36 |
| 2011/0080445 | A1* | 4/2011 | Shimizu et al. | 347/31 |
| 2012/0069086 | A1 | 3/2012 | Tanaka | |

FOREIGN PATENT DOCUMENTS

JP 2012-086551 A 5/2012

* cited by examiner

*Primary Examiner* — Jason Uhlenhake
(74) *Attorney, Agent, or Firm* — Global IP Counselors, LLP

(57) ABSTRACT

To provide a waste ink absorber excellent in permeability and retention performance, it is directed to a waste ink absorber for absorbing waste ink discharged from a head for ejecting ink. In a side cross-sectional view of the waste ink absorber, a portion low in density and a portion higher in density as compared with the portion low in density are laid alternately obliquely.

6 Claims, 4 Drawing Sheets

WASTE INK ABSORBER, WASTE INK TANK, LIQUID DROPLET EJECTING DEVICE

CROSS-REFERENCE TO RELATED APPLICATIONS

This application claims priority to Japanese Patent Application No. 2012-284513 filed on Dec. 27, 2012. The entire disclosure of Japanese Patent Application No. 2012-284513 is hereby incorporated herein by reference.

BACKGROUND

1. Technical Field

The present invention relates to a waste ink absorber, a waste ink tank, and a liquid droplet ejecting device.

2. Background Technology

As a waste ink tank for collecting discharged ink, a structure in which a plurality of ink absorbers are arranged in an piled manner in a tank main body is known (see, e.g., Patent Document 1).

Japanese Laid-open Patent Publication No. 2012-86551 (Patent Document 1) is an example of the related art.

SUMMARY

Problems to be Solved by the Invention

However, since the density of each waste liquid absorbing material arranged in the waste ink tank in an piled manner is almost uniform, there were problems that, when the permeability of the waste liquid with respect to the waste liquid absorbing material is relatively good, the retention performance for retaining the absorbed waste liquid deteriorates, while when the retention performance of the absorbed waste liquid with respect to the waste liquid absorbing material is relatively good, the permeability for absorbing the waste liquid deteriorates.

Means Used to Solve the Above-Mentioned Problems

The invention was made to solve at least a part of the aforementioned problems, and is capable of realizing as the following embodiment or applied example.

Application Example 1

The waste ink absorber according to this applied example is a waste ink absorber for absorbing waste ink discharged from a head for ejecting ink, characterized in that, in a side cross-sectional view of the waste ink absorber, a portion low in density and a portion higher in density as compared with the portion low in density are laid alternately and obliquely.

With this structure, the low density portion and the high density portion appear on a surface of the waste ink absorber. The waste ink discharged toward the surface of the waste ink absorber comes into contact with both the low density portion and the high density portion. So, the waste ink is quickly absorbed from the low density portion. The impregnated waste ink gradually permeates the low density portion and the absorbed waste ink is retained. Accordingly, a waste ink absorber satisfying with both permeability and retention performance of waste ink can be provided. Further, since both the low density portion and the high density portion appear on the surface of the waste ink absorber, it is not required to define a surface for absorbing waste ink. This eliminates the need for specifying, e.g., arrangement direction of the waste ink at the time of the assembly, which in turn can simplify the working steps. The waste ink denotes, for example, ink which was discharged from a head but not reached a medium. Specifically, the waste ink denotes ink generated by flushing for ejecting ink for the purpose of preventing increasing of ink viscosity, etc., or cleaning for forcibly discharging ink with a pump, etc., for the purpose of recovering of a nozzle which became unable to inject ink by increased ink viscosity or destruction of meniscu, influence of paper powder, etc., or preventing increasing ink viscosity. Further, in the so-called borderless printing, since the ink deviated from the medium is also ink failed to reach the medium, it is included in a waste ink.

Application Example 2

In the waste ink absorber according to the aforementioned applied example, it is characterized in that a plurality of the waste ink absorbers are piled.

With this structure, even on the surface piled with each other, the low density portion and the high density portion appear. Therefore, the waste ink absorbed from one waste ink absorber can also be impregnated to the other waste ink absorber in an efficient manner. Accordingly, while keeping the retention performance of the waste ink, the absorption permissible amount of the waste ink can be increased.

Application Example 3

In the waste ink absorber according to the applied example, it is characterized in that largest surfaces of waste ink absorbers among surfaces constituting the waste ink absorber are brought into contact with each other.

With this structure, in the portion large in area, the area of the low density portion greatly appears. Therefore, it becomes possible to more easily impregnate the waste ink.

Application Example 4

A waste ink tank according to this applied example is characterized in that the waste ink tank is equipped with the waste ink absorber and a container portion for containing the waste ink absorber.

With this structure, by containing the waste ink absorber having waste ink permeability and retention property, for example, even in cases where the waste ink tank is arranged obliquely or sideways, the absorbed waste ink can be retained to prevent leakage, etc., which in turn can provide a highly-reliable waste ink tank.

Application Example 5

The liquid droplet ejecting device is characterized in that the device is equipped with a head for ejecting ink and the aforementioned waste ink tank for capturing waste ink discharged from the head.

With this structure, the waste ink discharged from the head is captured by the waste ink absorber contained in the waste ink tank. In the ink absorber, the low density portion and the high density portion are laid obliquely and alternately, and therefore it is excellent in permeability and retention property of waste ink. Therefore, the ink absorber absorbs waste ink efficiently, which makes it possible to miniaturize the ink absorber as a waste ink tank and also to miniaturize the ink absorber as a liquid droplet ejecting device. Further, a highly-reliable liquid droplet ejecting device which causes no defect such as ink leakage can be provided.

BRIEF DESCRIPTION OF THE DRAWINGS

Referring now to the attached drawings which form a part of this original disclosure.

DETAILED DESCRIPTION OF EXEMPLARY EMBODIMENTS

Embodiments

Hereinafter, embodiments of the invention will be explained with reference to the drawings. In each of the following drawings, the measurement of each member, etc., is shown to be different from the actual measurement in order to attain recognizable size of each member, etc.

Figure 1A:
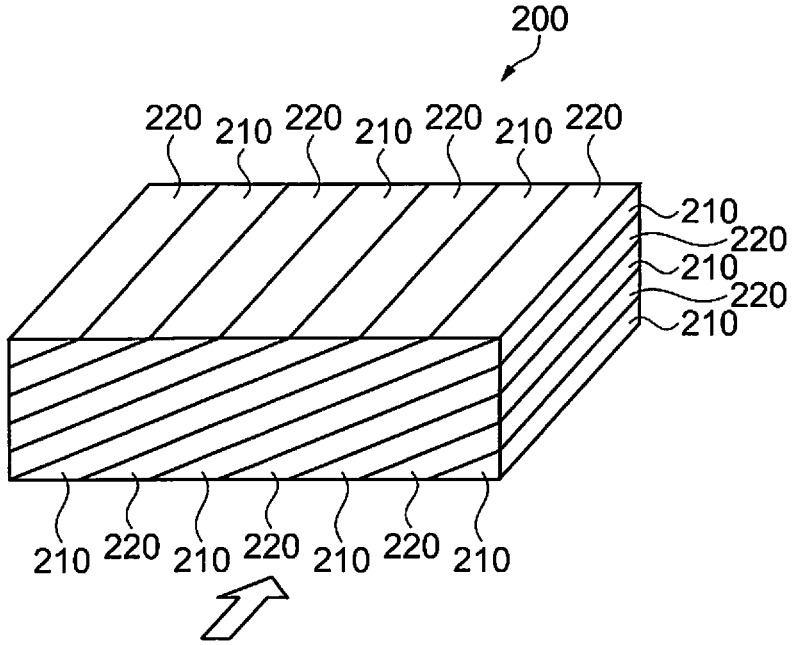
FIGS. 1A and 1B are schematic views showing a structure of a waste ink absorber.
Figure 1B:
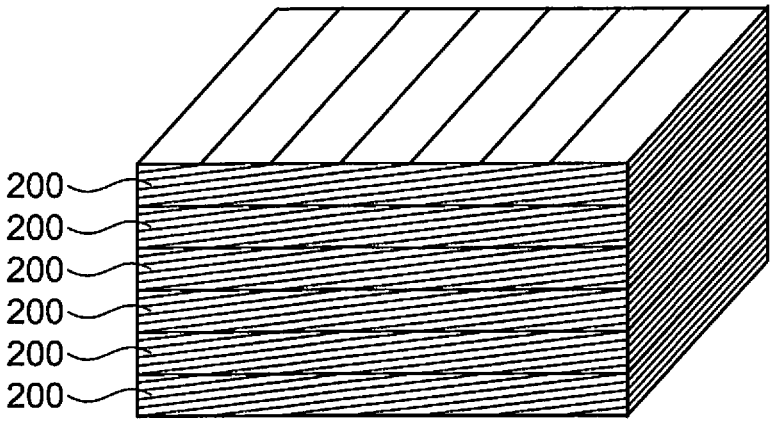

First, the structure of the waste ink absorber will be explained. FIGS. 1A and 1B are schematic views showing a structure of a waste ink absorber. FIG. 1A shows the structure of a single piece of the waste ink absorber. The waste ink absorber 200 is configured to absorb waste ink discharged from a head for ejecting ink. As shown in FIG. 1A, in the side cross-sectional view of the waste ink absorber 200 of a rectangular shape, the waste ink absorber 200 includes a portion 210 high in density and a portion 220 lower in density as compared with the portion 210 low in density, and the low density portion (layer) 220 and the high density portion (layer) 210 are laid alternately and obliquely. This oblique lamination extends in a direction perpendicular to a surface appearing the oblique lamination. Further, the obliquity of the oblique lamination denotes an obliquity with respect to the surface perpendicular to a surface appearing the oblique lamination. By making oblique plural laminations of the low density portion 220 and the high density portion 210 appear on one surface, it becomes possible to make the low density portion 220 and the high density portion 210 appear alternately and repeatedly on each surface of the waste ink absorber 200 perpendicular to the one surface. On a surface perpendicular to the one surface, it becomes a parallel or perpendicular layer, not an oblique lamination layer, with respect to each surface perpendicular to the surface. In other words, in three surfaces perpendicular to each other, the waste ink absorber 200 includes one surface appearing oblique lamination and two surfaces appearing parallel lamination. With this, on any surface, the low density portion and the high density portion appear alternately, which makes it possible to easily attain absorption of waste ink from any surface. Further, since the high density portion 210 higher in density as compared with the low density portion 220 is formed, it is possible to make the low density portion 220 absorb waste ink easily (promptly). Further, although at the portion 210 high in density, the permeability of waste ink deteriorates as compared with the portion low in density, the portion 210 has retention property for retaining absorbed waste ink.

Here, it is preferable to structure such that a plurality of laminations of the portion 220 low in density and the portion 210 high in density exist in a vertical direction from the surface of the waste ink absorber 200 which receives waste ink droplets. By structuring as mentioned above, the waste ink absorbed from the low density portion 220 permeates along the low density portion 220 and, by gravity, further permeates the high density portion 210 arranged below the low density portion 220 and a low density portion 220 arranged below the high density portion 210. Thus, the efficiency of permeability and retention performance can be further enhanced. Furthermore, by making oblique laminations, provided that absorbers are the same in thickness, more layers can be formed as compared to the case of making horizontal laminations.

The width dimension, the number of laminations, etc., of the low density portion 220 and the high density portion 210 can be set arbitrarily. For example, on a surface of the waste ink absorber 200 which receives waste ink, it is preferable to laminate the low density portion 220 and the high density portion 210 so that the lamination width becomes narrower than the width of the waste ink droplet. By structuring as mentioned above, since a waste ink droplet comes into contact with both the low density portion 220 and the high density portion 210, it is possible to make the waste ink assuredly absorb from the low density portion 220.

The waste ink absorber 200 is a mixture including cellulose fibers, thermoplastic resin, and flame retardant, and the density of the low density portion 220 and the high density portion 210 is the density of the cellulose fibers, thermoplastic resin, or retardant.

The cellulose fibers are obtained by fibrillating a pulp sheet, etc., using, for example, a dry type fibrillating machine such as a rotary crushing apparatus, etc. The thermoplastic resin contributes to bonding of the cellulose fibers, retention of an appropriate strength (hardness, etc.) of the waste ink absorber 200, prevention of scattering of paper powder/fibers, and maintaining of the shape at the time of absorbing waste ink. The thermoplastic resin allows adaption of any configurations such as a fiber form or a powder form. By heating the mixture in which the cellulose fibers and the thermoplastic resin are mixed, the thermoplastic resin can be thermoplastic, the cellulose fibers are bonded each other. It is preferable that the welding is performed at a temperature not causing thermal deterioration of the cellulose fibers, etc. The thermoplastic resin is preferably fibrous resin which is easily tangled with paper fibers in the fibrillated fabric. Further, it is preferable to be a composite fiber of a core-in-sheath structure. In the thermoplastic resin of the core-in-sheath structure, the peripheral sheath portion melts at a low temperature, and the fibrous core portion is bonded to the thermoplastic resin itself or the cellulose fiber, resulting in a strong juncture.

The flame retardant is added to give flame retardant properties to the waste ink absorber 200. As a flame retardant, for example, inorganic materials such as aluminum hydrate, magnesium hydrate, etc. or phosphorous organic materials (for example, such as aromatic ester phosphate such as triphenylphosphate) can be used.

As a method of forming the waste ink absorber 200, for example, a mixture in which cellulose fibers, thermoplastic resin and flame retardant are mixed is screened to accumulate on a mesh belt arranged below the screen to form a deposited material. At this time, the mesh belt is moved at a predetermined rate to make a deposited material so as to form a portion low in density and a portion high in density. Then, the formed deposit is subjected to a pressurization and heating treatment. With this, the thermoplastic resin is fused into a predetermined thickness. By subjecting it to die cutting into a desired size, a waste ink absorber 200 is formed.

FIG. 1B shows a structure in which a plurality of waste ink absorbers 200 are piled. In FIG. 1B, a plurality of waste ink absorbers 200 is arranged in an piled manner. In this embodiment, it shows a structure in which 6 pieces of waste ink absorbers 200 are piled. Further, the largest surfaces of the waste ink absorbers 200, among the surfaces constituting the waste ink absorber 200, are in contact with each other. With this, the permeability of waste ink can be secured, and the absorption acceptable amount of waste ink can be increased. The structure of each waste ink absorber 200 is the same as the structure shown in FIG. 1A, and therefore the explanation will be omitted.

Figure 2:
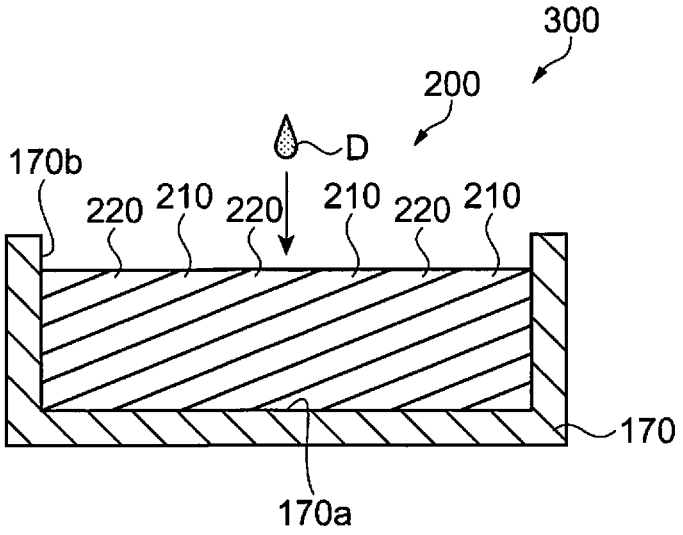
FIG. 2 is a cross-sectional view showing a structure of the waste ink absorber.

Next, the structure of the waste ink tank will be explained. FIG. 2 is a cross-sectional view showing the structure of another waste ink tank. As shown in FIG. 2, the waste ink tank 300 is equipped with a waste ink absorber 200 for absorbing waste ink and an containing portion 170 for containing the waste ink absorber 200.

The waste ink absorber 200 includes, in a side cross-sectional view, a portion 220 low in density and a portion 210 higher in density as compared with the low density portion 220, and the low density portion 220 and the high density portion 210 are laid alternately and obliquely. By obliquely laminating the low density portion 220 and the high density portion 210, the low density portion 220 and the high density portion 210 appear on the surface of the waste ink absorber 200. Therefore, it becomes possible to absorb waste ink from any surface, eliminating the necessity of regulating the arrangement direction, etc., of the waste ink absorber 200, which in turn can reduce the number of assembly steps.

The containing portion 170 for containing the waste ink absorber 200 is, for example, formed into a rectangular shape by plastic material. The containing portion 170 includes a bottom surface portion 170*a* and a side surface portion 170*b*, and is formed to be able to accommodate and retain the waste ink absorber 200.

As shown in FIG. 2, a waste ink droplet D is discharged toward the waste ink absorber 200. Arriving the surface of the waste ink absorber 200, the waste ink droplet D comes into contact with both the low density portion 220 and the high density portion 210 appearing on the surface of the waste ink absorber 200. The waste ink is efficiently absorbed from the low density portion 220. The absorbed waste ink is retained by the high density portion 210 laid alternately.

In the aforementioned waste ink tank 300, a structure using a single piece of the waste ink absorber 200 is employed, but not limited to it. For example, it can be structured such that a plurality of waste ink absorbers 200 is piled. In this case, the absorption acceptable amount of the waste ink can be further increased. Further, in the waste ink tank 300, the largest surface is arranged (horizontally arranged) in a horizontal direction, but not limited to it, and the largest surface can be arranged (vertically arranged) in the vertical direction. Also in this case, waste ink can be impregnated and retained.

Next, the structure of the liquid droplet ejecting device will be explained. The liquid droplet ejecting device is equipped with a head for ejecting ink and a waste ink tank for capturing waste ink discharged from the head. In the liquid droplet ejecting device of this embodiment, the structure equipped with the aforementioned waste ink absorber 200 and the waste ink tank 300 will be explained.

Figure 3:
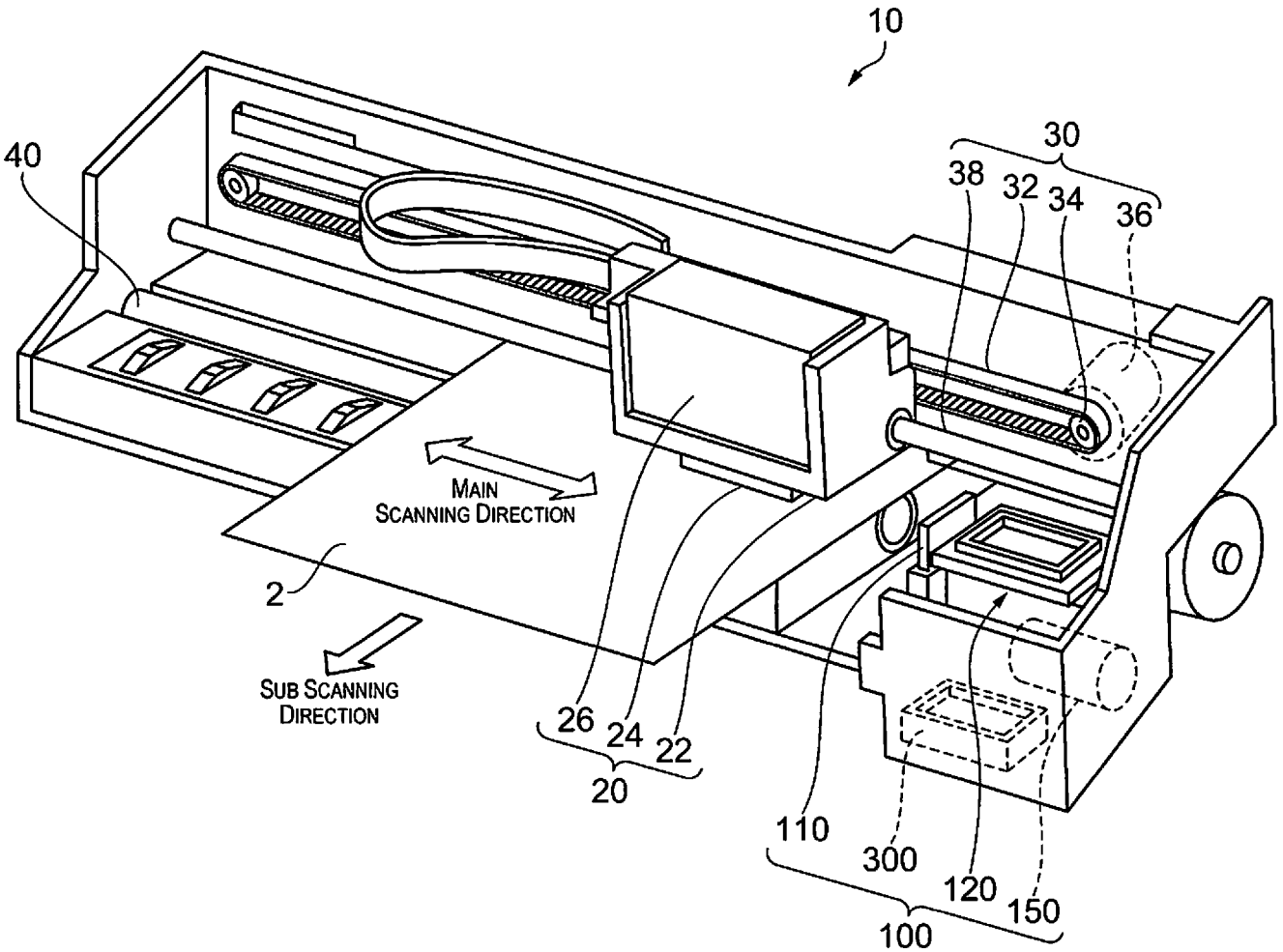
FIG. 3 is a schematic view showing a structure of a liquid droplet ejecting device.

FIG. 3 is a schematic view showing a structure of a liquid droplet ejecting device. As shown in FIG. 3, the liquid droplet ejecting device 10 is constituted by, e.g., a carriage 20 for forming ink dots on a printing medium 2 such as a printing paper while reciprocating in the main scanning direction, a drive mechanism 30 for reciprocating the carriage 20, a platen roller 40 for feeding the printing medium 2, a maintenance mechanism 100 for performing maintenance to enable normal printing, etc. The carriage 20 is provided with an ink cartridge 26 containing ink, a carriage case 22 for attaching the ink cartridge 26, a head 24 for ejecting ink mounted on the bottom surface side (the side facing the printing medium 2) of the carriage case 22, etc. In the head 24, a plurality of nozzles for ejecting ink is formed. The ink in the ink cartridge 26 is introduced to the head 24, and injected onto the printing medium 2 by the exact amount to thereby print an image.

The drive mechanism 30 for reciprocating the carriage 20 is constituted by the guide rail 38 extending in the main scanning direction, a timing belt 32 having a plurality of teeth on the inside, a drive pulley 34 engaged with the teeth of the timing belt 32, a step motor 36 for driving the drive pulley 34, etc. A part of the timing belt 32 is fixed to the carriage case 22, and by driving the timing belt 32, the carriage case 22 can be moved along the guide rail 38. Further, since the timing belt 32 and the driving pulley 34 are engaged with each other by the teeth, when the driving pulley 34 is driven by the step motor 36, it is possible to move the carriage case 22 depending on the driven amount with high accuracy.

The platen roller 40 for feeding the printing medium 2 is driven by a non-illustrated driving motor and gear mechanism, so that the printing medium 2 can be fed by a certain amount in a sub scanning direction.

The maintenance mechanism 100 is arranged in a region called a home position located outside the printing region, and is provided with a wiper blade 110 for sweeping the surface (nozzle surface) to which an injection nozzle is formed on the bottom surface side of the head 24, a cap unit 120 for capping the head 24 by being pressed against the nozzle surface of the head 24, and a suction pump 150 for discharging ink as waste ink by being driven in a state in which the head 24 is capped with the cap unit 120. The suction pump 150 forcibly discharges ink from the head 24 to thereby recover the nozzle which became unable to inject ink due to increased viscosity, destruction of meniscus, influence of paper powder, etc., or prevent the ink in the nozzle from being increased in viscosity. Further, below the suction pump 150, a waste ink tank 300 for capturing the waste ink discharged from the suction pump 150. By providing the waste ink tank 300, the outer shape of the liquid droplet ejecting device 10 increases. By improving the ink permeability and retaining properties of the waste ink absorber 200, the volume of the waste ink absorber 200 capable of retaining the same amount of ink can be reduced. With this, the size of the waste ink tank 300 and liquid droplet ejecting device 10 is reduced. The waste ink tank 300 has the same structure as the structure explained with reference to FIG. 2, and therefore the explanation will be omitted. The discharged ink also includes ink by flushing that flushes ink for the purpose of viscosity increase prevention, and ink failed to reach a medium such as the ink injected outside a medium in the so-called borderless printing. Therefore, the waste ink is not limited to the ink discharged by the suction pump 150. The waste ink denotes ink which was discharged from a head but not reached a medium.

According to the aforementioned embodiments, the following effects can be obtained.

(1) On the surface of the waste ink absorber 200, the low density portion 220 and the high density portion 210 appear. The waste ink discharged toward the surface of the waste ink absorber 200 comes into contact with both the low density portion 220 and the high density portion 210. So, the waste ink is absorbed promptly from the low density portion 220 with which the waste ink came into contact. Then, the permeated ink gradually permeates the high density portion 210 and the absorbed ink is retained. Accordingly, a waste ink absorber 200 equipped with permeability and retention performance of waste ink can be provided. Further, on the surface of the waste ink absorber 200, both the low density portion 220 and the high density portion 210 appear, and therefore it is not required to define a surface for absorbing waste ink, which can simplify the number of steps of the assembling work.

(2) In the aforementioned waste ink tank 300 equipped with the waste ink absorber 200, even in cases where the waste ink tank 300 is arranged slightly sideways, the absorbed waste ink can be retained, and therefore the leakage thereof, etc., can be prevented.

(3) In the aforementioned liquid droplet ejecting device 10 equipped with the waste ink tank 300, it is possible to efficiently absorb the waste ink discharged from the head 24, prevent generation of defects such as ink leakage, etc., and secure the reliability.

Example 1

Next, concrete examples of the invention will be explained.

1. Mixture (1) Cellulose Fiber

A pulp sheet cut into a few centimeters using a cutting machine was fibrillated into a cotton-like manner with a turbo mill (made by Turbo Corporation).

(2) Thermoplastic Resin

Thermoplastic resin had a core-in-sheath structure. The sheath was made of polyethylene melting at 100° C. or above, and the core was made of a thermoplastic fiber of 1.7 dtex (Tetron, made by Teijin Ltd.) made of polyester.

(3) Flame Retardant

Aluminum hydroxide B53 (made of Nippon Light Metal Company, Ltd.)

2. Formation of Waste Ink Absorber

Example 1

Formation of Waste Ink Absorber A

A mixture C1 in which 100 weight parts of cellulose fibers, 15 weight parts of thermoplastic fibers, and 10 weight parts of flame retardant were mixed in air, a mixture C2 in which 100 weight parts of cellulose fibers, 25 weight parts of thermoplastic fibers, and 10 weight parts of flame retardant were mixed in air were deposited alternately on the mesh belt. At this time, the mixtures C1 and C2 were alternately deposited continuously while moving the mesh belt. The mixtures can be deposited while being suctioned with a suction device. In Example 1, the mixture C1 and the mixture C2 were deposited alternately 6 times respectively. Then, the deposited material was subjected to a heating and pressurization treatment at 200° C. Thereafter, it was cut into 150 mm×50 mm×12 mm to form a waste ink absorber A. In this waste ink absorber A, an oblique laid body in which the portion low in density (0.15 g/cm$^3$) and the portion high in density (0.17 g/cm$^3$) due to the difference of the thermoplastic resin amount were laid repeatedly was formed.

Example 2

Formation of Waste Ink Absorber B

A mixture C1 in which 100 weight parts of cellulose fibers, 15 weight parts of thermoplastic fibers, and 10 weight parts of flame retardant were mixed in air, and a mixture C3 in which 100 weight parts of cellulose fibers, 15 weight parts of thermoplastic fibers, and 20 weight parts of flame retardant were mixed in air were deposited alternately on the mesh belt. At this time, the mixtures C1 and C3 were alternately deposited continuously while moving the mesh belt so that the mixtures C1 and C3 are laid obliquely. The mixtures can be deposited while being suctioned with a suction device. In Example 2, the mixture C1 and the mixture C3 were deposited alternately 6 times respectively. Then, the deposited material was subjected to a heating and pressurization treatment at 200° C. Thereafter, it was cut into 150 mm×50 mm×12 mm to form a waste ink absorber B. In this waste ink absorber B, an oblique laid body in which the portion low in density (0.15 g/cm$^3$) and the portion high in density (0.17 g/cm$^3$) due to the difference of the thermoplastic resin amount were laid repeatedly was formed. In Example 2, it is not required to contain flame retardant evenly in the thickness direction of the waste ink absorber B, and therefore the used amount of the flame retardant could be reduced.

Example 3

Formation of Waste Ink Absorber C

A mixture C1 in which 100 weight parts of cellulose fibers, 15 weight parts of thermoplastic fibers, and 10 weight parts of flame retardant were mixed in air was deposited on a mesh belt. At this time, the mixture C1 was deposited while moving the mesh belt. Then, the deposited material of the deposited mixture C1 was subjected to a heating and pressurization treatment at 200° C. Then, a mixture C4 in which 150 weight parts of cellulose fibers, 15 weight parts of thermoplastic fibers, and 10 weight parts of flame retardant were mixed in air was deposited on the mixture C1 subjected to a pressurization and heating treatment. At this time, the mixture C4 was deposited while moving the mesh belt. Then, the deposited material of the deposited mixture C4 was subjected to a heating and pressurization treatment at 200° C. Thereafter, the mixture C1 and the mixture C4 were deposited alternately 6 times respectively, and subjected to a pressurization and heating treatment. In Example 3, the mixture C1 and the mixture C4 were deposited alternately 6 times respectively. Thereafter, it was cut into 150 mm×50 mm×12 mm to form a waste ink absorber C. In this waste ink absorber C, an oblique laid body in which the portion low in density (0.15 g/cm$^3$) and the portion high in density (0.17 g/cm$^3$) due to the difference of the thermoplastic resin amount were laid repeatedly was formed.

Example 4

Formation of Waste Ink Absorber D

A mixture C1 in which 100 weight parts of cellulose fibers, 15 weight parts of thermoplastic fibers, and 10 weight parts of flame retardant were mixed in air was deposited on a bottom surface having an inclined shape. Then, a mixture C2 in which 100 weight parts of cellulose fibers, 25 weight parts of thermoplastic fibers, and 10 weight parts of flame retardant were mixed in air was deposited on the deposited mixture C1.

Thereafter, the mixture C1 and the mixture C2 were deposited alternately. Then, the deposited material was subjected to a heating and pressurization treatment at 200° C. Thereafter, it was cut into 150 mm×50 mm×12 mm to form a waste ink absorber D. In this waste ink absorber D, an oblique laid body in which the portion low in density (0.15 g/cm$^3$) and the portion high in density (0.17 g/cm$^3$) due to the difference of the thermoplastic resin amount were laid repeatedly was formed.

Comparative Example 1

Formation of Waste Ink Absorber R

A mixture C1 in which 100 weight parts of cellulose fibers, 15 weight parts of thermoplastic fibers, and 10 weight parts of flame retardant were mixed in air was deposited on a mesh belt. Then, a mixture C2 in which 100 weight parts of cellulose fibers, 25 weight parts of thermoplastic fibers, and 10 weight parts of flame retardant were mixed in air was deposited on the deposited mixture C1. At this time, the mesh belt was not moved. Thereafter, the mixture C1 and the mixture C2 were deposited alternately. Then, the deposited material was subjected to a heating and pressurization treatment at 200° C. Thereafter, it was cut into 150 mm×50 mm×12 mm to form a waste ink absorber R. In the waste ink absorber R, the low density portion (0.15 g/cm$^3$) and the high density portion (0.17 g/cm$^3$) due to the difference of thermoplastic fiber amount appeared, but, different from the structure of the waste ink absorber A, B, C, D formed in Examples 1 to 4, a laid body in which the low density portion and the high density portion were laid flatly was formed. In other words, it was not a laid body in which the low density portion and the high density portion were laid obliquely.

3. Evaluation

Next, in the aforementioned Examples 1 to 4 and Comparative Example 1, the ink permeability, the ink retention property and the ink deposition property will be evaluated. Each evaluation method is as follows.

(a) Evaluation Method of Ink Permeability and Ink Retention Property

Figure 4A:
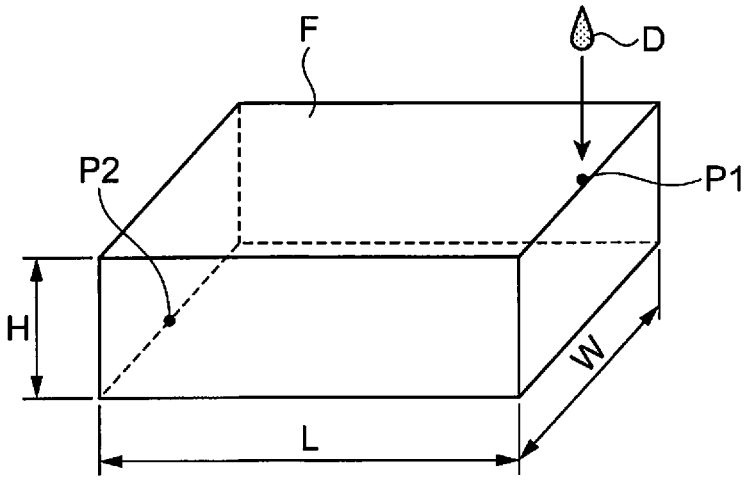
FIGS. 4A and 4B are schematic views showing an evaluation method of the ink permeability and retention property of the waste ink absorber.
Figure 4B:
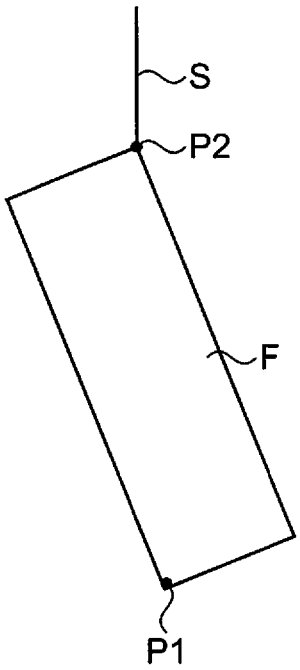

FIGS. 4A and 4B are schematic drawings showing an evaluation method of the ink permeability and ink retention property of the waste ink absorber. As shown in FIG. 4A, an ink absorbing member F of 150 mm (L)×50 mm (W)×12 mm (H) is placed on a flat surface, and ink of 80 ml is slowly poured in from the first point P1 on the upper surface. If the ink does not permeate the absorbing member F, it is left for 5 minutes, and then pouring is continued. In cases where the ink does not permeate even if it is left for 5 minutes, it is assumed that ink does not permeate, and the judgment of the ink permeability is NG. On the other hand, in cases where all ink permeate, the judgment of the ink permeability is OK. When all ink was poured in, it is left for 5 minute, and then as shown in FIG. 4B, the member is hanged from the second point P2 using a strap, etc., so that the first point P1 from which the ink was poured is arranged downward. In this hanging state, the impregnated ink gathers at one end portion of the ink absorbing member F and becomes hard to be retained. When the ink drips off from the ink absorbing member F, it is assumed that ink cannot be retained, and therefore the judgment of the ink retention property becomes NG. On the other hand, when the ink does not drip off, the judgment of the ink retention property becomes OK. If the judgment of the ink permeability is NG, since a predetermined amount of ink cannot be absorbed, the judgment of the ink retention property is not preformed. With this evaluation, it is understood that no ink will leak even if the liquid droplet ejecting device or the waste ink tank is inclined.

(b) Evaluation Method of Ink Deposition Property

An ink absorber F of 150 mm (L)×50 mm (W)×12 mm (H) is placed on a flat surface, and under the circumstance of 20% RH at 40° C., ink is dropped by 0.4 g at a time on a central portion on the upper surface of the placed absorber F. After passing 240 hours, if the thickness of the solid deposited material on the surface of the ink absorber F is less than 1 mm, the judgment of the ink deposition property is OK. On the other hand, if the thickness of the deposited material is 1 mm or more, the judgment of the ink deposition property is NG.

In the aforementioned Examples and Comparative Examples, the ink permeability, the ink retention property and the ink deposition property were evaluated. The evaluation results are shown in Table 1.

TABLE 1

| | Ink permeability | Ink retention property | Ink deposition property |
|---|---|---|---|
| Example 1 | OK | OK | OK |
| Example 2 | OK | OK | OK |
| Example 3 | OK | OK | OK |
| Example 4 | OK | OK | OK |
| Comparative Example 1 | NG | — | NG |

As shown in Table 1, according to the waste ink absorbers A, B, C, D (Example 1, 2, 3, 4) according to the invention, all of evaluations on the ink permeability, the ink retention performance, and the ink deposition property were excellent. On the other hand, in the waste ink absorber R of Comparative Example 1, no satisfactory result could be obtained in terms of the ink retaining property. In Comparative Example 1, since it is a flat-shaped lamination, the distance of the layer in the horizontal direction becomes long, ink would not permeate to the end portion especially at the high density portion. This deteriorates the ink permeability, and the ink not sufficiently impregnated remains on the surface to cause a deposition, deteriorating the ink deposition property. On the other hand, in Examples 1-4, the lamination is inclined, and therefore the length of the layer is short. As a result, even at the high density portion, ink easily impregnates to the end portion of the layer.

In some cases, the oblique laid layer of the high density portion and the low density portion which are features of this application can be recognized by the appearance by eye. As the method of verification in the case, by tearing off the waste ink absorber after absorbing water or ink, the direction of the layer can be recognized. Further, by dripping ink, if there is a layer into which ink is easily impregnated, it can be said that it is a laid layer oblique in density. In cases where the entire waste ink absorber is uniform in density, when ink is dropped, the ink permeates evenly in the right and left direction while permeating in the up and down direction by the gravity. In the case of a layer in which the density changes horizontally, there is a layer which easily permeates right and left.

The aforementioned Examples are employed as a waste ink tank 300 and a waste ink tank 200 for use in a liquid droplet ejecting device 10. Here, ink includes various kinds of liquid compositions, such as, common aqueous ink, oil ink, pigment ink, dye ink, solvent ink, resin ink, sublimation transfer ink, gel ink, hot melt ink, ultraviolet cure ink, etc. Further, ink can be any materials that a head 24 can inject. For example, it is enough that the material is in a liquid phase state, and ink includes not only liquid crystal, a liquid state material high or low in viscosity, sol, gel liquid, fluid material such as inorganic solvent, organic solvent, solution, liquid resin, liquid metal (metal thermoplastic solution), liquid as one condition of a material, but also a material in which functional material particles of solid materials such as pigments or metal particles are dissolved, dispersed or mixed in a solvent, etching liquid, lubricating oil. Further, the liquid droplet ejecting device can be, other than an ink jet printer, a device for ejecting ink including electrode materials or materials such as coloring materials used to produce, for example, a liquid crystal display, an EL (electroluminescence) display, a surface emitting display, or a color filter in a dispersed or dissolved manner, a device for ejecting a bio organic substance for use in a bio chip production, a device for ejecting ink as a sample used as a precision pipette, a printing device or a micro dispenser. Furthermore, a device for ejecting lubricating oil to a precision machine such as a clock, a camera, etc., at a pin point, a device for forming, e.g., a small rounded lens (optical lens) for use as an optical communication element, a device for ejecting ultraviolet curable liquid and hardening it by light or heat, or a device for ejecting etching liquid such as acid, alkali, etc., to etch a substrate, etc., can be employed. The invention can be applied to any one of liquid droplet ejecting device among these devices.

In the aforementioned Examples, in order to prevent fluffing of the surface of a waste ink absorber 200, a thin nonwoven fabric can be adhered to the surface. The nonwoven fabric to be adhered is thin as compared with the waste ink absorber 200, the influence to the ink permeability or retaining performance is small. In the aforementioned Examples, the waste ink absorber is formed into a rectangular shape, but not limited to it. A rectangular shape can partially have a cutting and/or dent, and the shape can be non-rectangular and include an arc portion and/or an inclined portion. In the drawings of the aforementioned Examples, it was depicted that the thickness of the low density portion and the thickness of the high density portion are approximately the same. This can be changed depending on the ink. For example, if ink is large in viscosity and hard to impregnate, it is preferable that the thickness of the low density portion is increased than the thickness of the high density portion to enhance the permeability. To the contrary, if the viscosity is small and it is easy to be impregnated, it is preferable that the thickness of the low density portion is decreased as compared to the high density portion. Although the density was described in each Example and Comparative Example, these are samples. The density is a numeral at the largest portion or the smallest portion.

In the aforementioned Examples, the pulp sheet includes a wood pulp of aconifer, a broad-leaf tree, etc., non-wood plant fibers such as hemp, cotton, kenaf, etc. In the aforementioned Examples, cellulose fibers are mainly used, but it is not limited to cellulose fibers as long as it is a material which can absorb ink and differentiate the density. The fiber can be a fiber made from plastic such as polyurethane or polyethylene terephthalate (PET) or another fiber such as wool. The method of forming the waste ink absorber is not limited to the method recited in the aforementioned Examples. As long as the features of the present application can be exerted, another production method such as a wet type method can be employed.

What is claimed is:

1. A waste ink absorber for absorbing waste ink discharged from a head for ejecting ink, wherein, in a side cross-sectional view of the waste ink absorber in an uncompressed state, a portion low in density and a portion higher in density as compared with the portion low in density are laid alternately and obliquely such that the portion low in density and the portion high in density appear alternately and repeatedly on each surface of the waste ink absorber.

2. The waste ink absorber according to claim 1, wherein a plurality of the waste ink absorbers are piled.

3. The waste ink absorber according to claim 2, wherein largest surfaces of waste ink absorbers among surfaces constituting the waste ink absorber are in contact with each other.

4. A waste ink tank comprising:

the waste ink absorber according to claim 1; and an containing portion for containing the waste ink absorber.

5. A liquid droplet ejecting device comprising:

a head for ejecting ink; and the waste ink tank according to claim 4 for capturing waste ink discharged from the head.

6. A waste ink absorber for absorbing waste ink discharged from a head for ejecting ink, wherein, in a side cross-sectional view of the waste ink absorber, a plurality of portions low in density and a plurality of portions higher in density as compared with the portions low in density are laid alternately and obliquely with respect to a surface perpendicular to a surface in a side cross-section of the waste ink absorber such that each portion low in density and each portion high in density appear alternately and repeatedly on each surface of the waste ink absorber.

* * * * *